US006409639B1

(12) United States Patent
Kuo

(10) Patent No.: US 6,409,639 B1
(45) Date of Patent: Jun. 25, 2002

(54) STRUCTURE OF EXERCISE WHEEL

(76) Inventor: Hsiu-Min Kuo, No. 138, Ming Hsing Street, Kweishan Hsiang, Taoyuan Hsien (TW)

( * ) Notice: Subject to any disclaimer, the term of this patent is extended or adjusted under 35 U.S.C. 154(b) by 0 days.

(21) Appl. No.: 09/925,493

(22) Filed: Aug. 10, 2001

(51) Int. Cl.[7] ..... A63B 21/00
(52) U.S. Cl. ..... 482/140; 482/132; 482/907
(58) Field of Search ..... 482/132, 140, 482/121, 907, 146, 147, 127, 116, 126, 13, 64, 68

(56) References Cited

U.S. PATENT DOCUMENTS 1,824,920 A * 9/1931 Novak ..... 482/132
3,752,475 A * 8/1973 Ott ..... 482/127
6,254,518 B1 * 7/2001 Yu ..... 482/140
6,264,587 B1 * 7/2001 Lee ..... 482/132

* cited by examiner

*Primary Examiner*—Jerome W. Donnelly
(74) *Attorney, Agent, or Firm*—Rosenberg, Klein & Lee

(57) ABSTRACT

An exercise wheel includes a housing, a wheel base equipped with two main wheels and a front balance wheel and mounted in the housing, a slide slidably mounted in a longitudinal track in the wheel base, a torsional spring disposed between the slide and the longitudinal track for providing the slide with a recovery force enabling the slide to return to its original position, and a belt connected between a wheel axle, which is rotated with the main wheels to take up/let off the belt when the user reciprocate the exercise wheel on the floor, and the slide.

4 Claims, 8 Drawing Sheets

STRUCTURE OF EXERCISE WHEEL

BACKGROUND OF THE INVENTION

The present invention relates to an exercise wheel and, more particularly, to such an exercise wheel, which is durable in use.

Various exercise wheel designs have been disclosed, and have appeared on the market. Similar designs are seen in U.S. Pat. No. 6,146,318 entitled "PUSH AND PULL TYPE ROLLER EXERCISER"; U.S. Pat. No. 6,017,296 entitled "EXERCISE WHEEL". The "EXERCISE WHEEL" of U.S. Pat. No. 6,017,296, as shown in FIG. 9, comprises a housing 51, a grip rod 52 which is put through the housing 51 such that both longitudinal ends thereof are left out in the outside of the housing 51, a main wheel 53 rotatably mounted on the grip rod 52 inside the housing 51, two auxiliary wheels 54 sets pivoted in the housing 51 such that they are linked with the main wheel 53, and at least one elastic recovery device, for example, a torsional spring 56 disposed between the main wheel 53 and the housing 51 for providing the main wheel 53 with a recovery force enabling the main wheel 53 to return to its original angular position. This design of exercise wheel is not durable in use because the torsional spring 56 wears quickly with use and no means is provided to limit the dead point of deformation of the torsional spring 56. Because the main wheel 53 and the auxiliary wheels 54 are gear wheels meshed together, teeth of the main wheel 53 and the auxiliary wheels 54 wear quickly with use and produce much noise during transmission. Further, the gear transmission design of the wheels 53;54 greatly increases the manufacturing cost of the exercise wheel. The design of "PUSH AND PULL TYPE ROLLER EXERCISER" of U.S. Pat. No. 6,146,318 has similar drawbacks.

SUMMARY OF THE INVENTION

The present invention has been accomplished to provide an exercise wheel, which eliminates the aforesaid drawbacks. It is the main object of the present invention to provide an exercise wheel, which is durable in use. It is another object of the present invention to provide an exercise wheel, which produces less noise during operation. According to one aspect of the present invention, the exercise wheel comprises a housing, a wheel base equipped with two main wheels and a front balance wheel and mounted in the housing, a slide slidably mounted in a longitudinal track in the wheel base, a torsional spring disposed between the slide and the longitudinal track for providing the slide with a recovery force enabling the slide to return to its original position, and a belt connected between a wheel axle, which is rotated with the main wheels to take up/let off the belt when the user reciprocate the exercise wheel on the floor, and the slide. Because the slide is mounted in the longitudinal track and moved to stretch/release the tensile spring, the longitudinal track limits the amount of deformation of the tensile spring. Further, because the invention eliminates the use of gear transmission means, less noise is produced during the operation of the exercise wheel.

DETAILED DESCRIPTION OF THE PREFERRED EMBODIMENT

Figure 1:
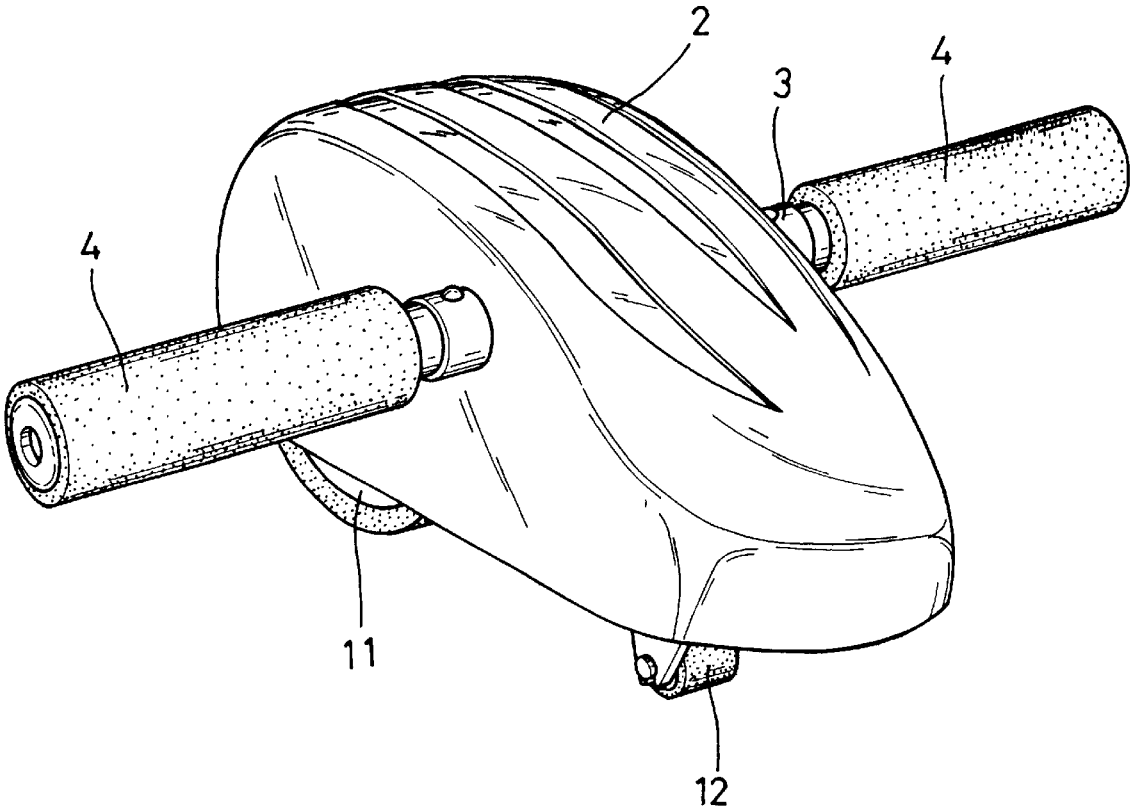
FIG. 1 is an elevational view of an exercise wheel according to the present invention.
Figure 2:
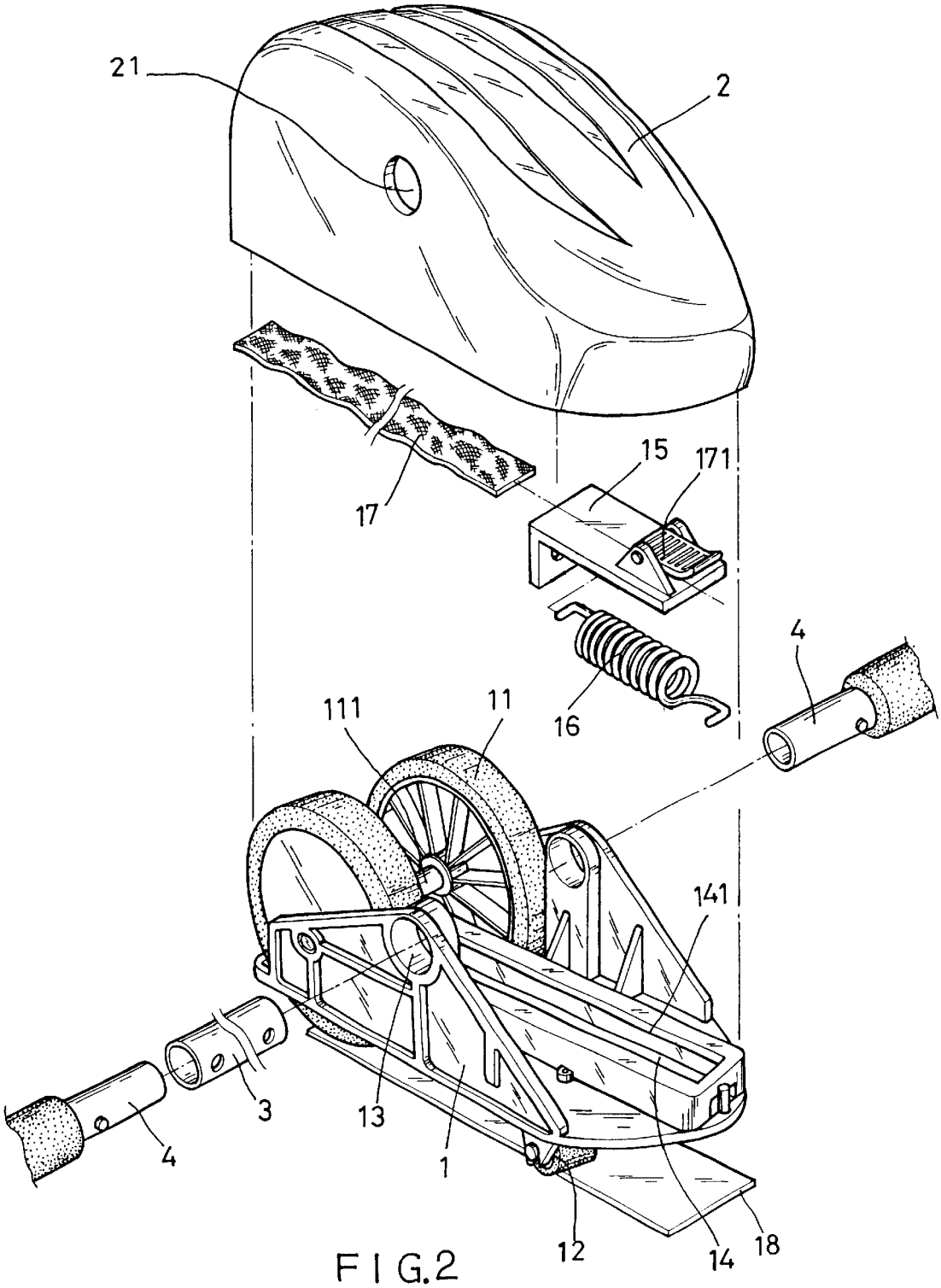
FIG. 2 is an exploded view of the exercise wheel according to the present invention.
Figure 3:
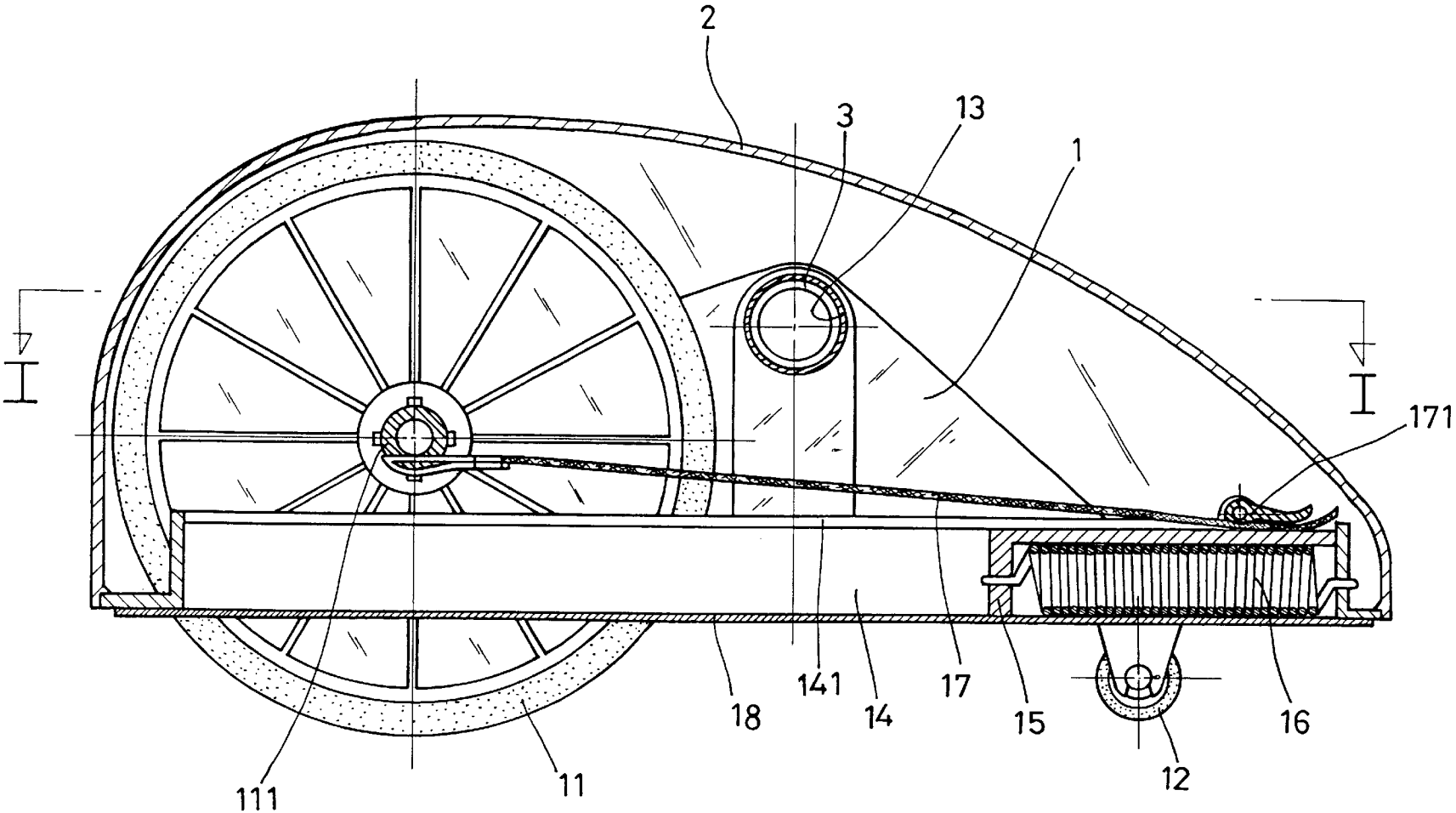
FIG. 3 is a longitudinal view in section in an enlarged scale of the exercise wheel according to the present invention.
Figure 4:
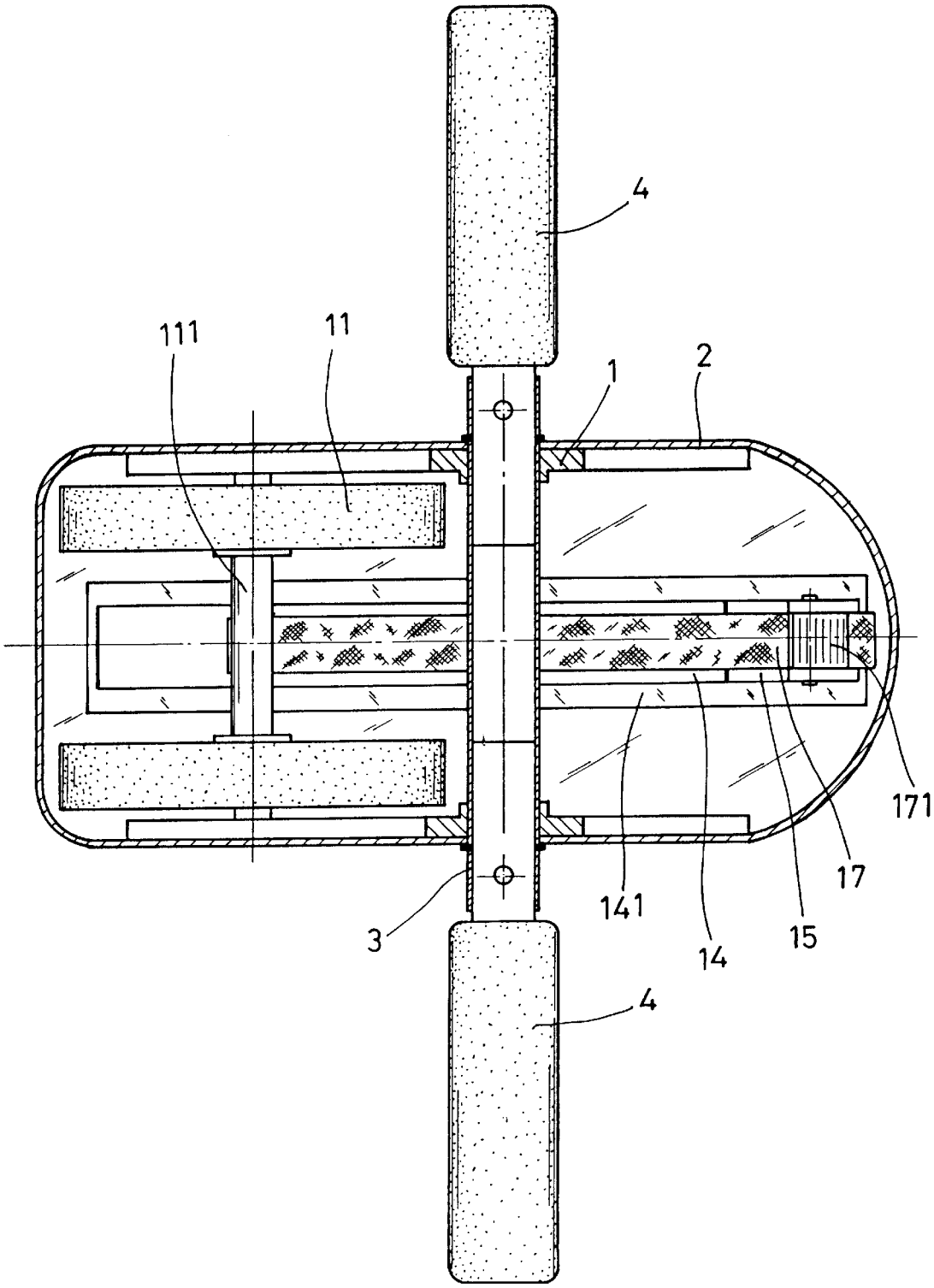
FIG. 4 is a sectional view taken along line I—I of FIG. 3.
Figure 5:
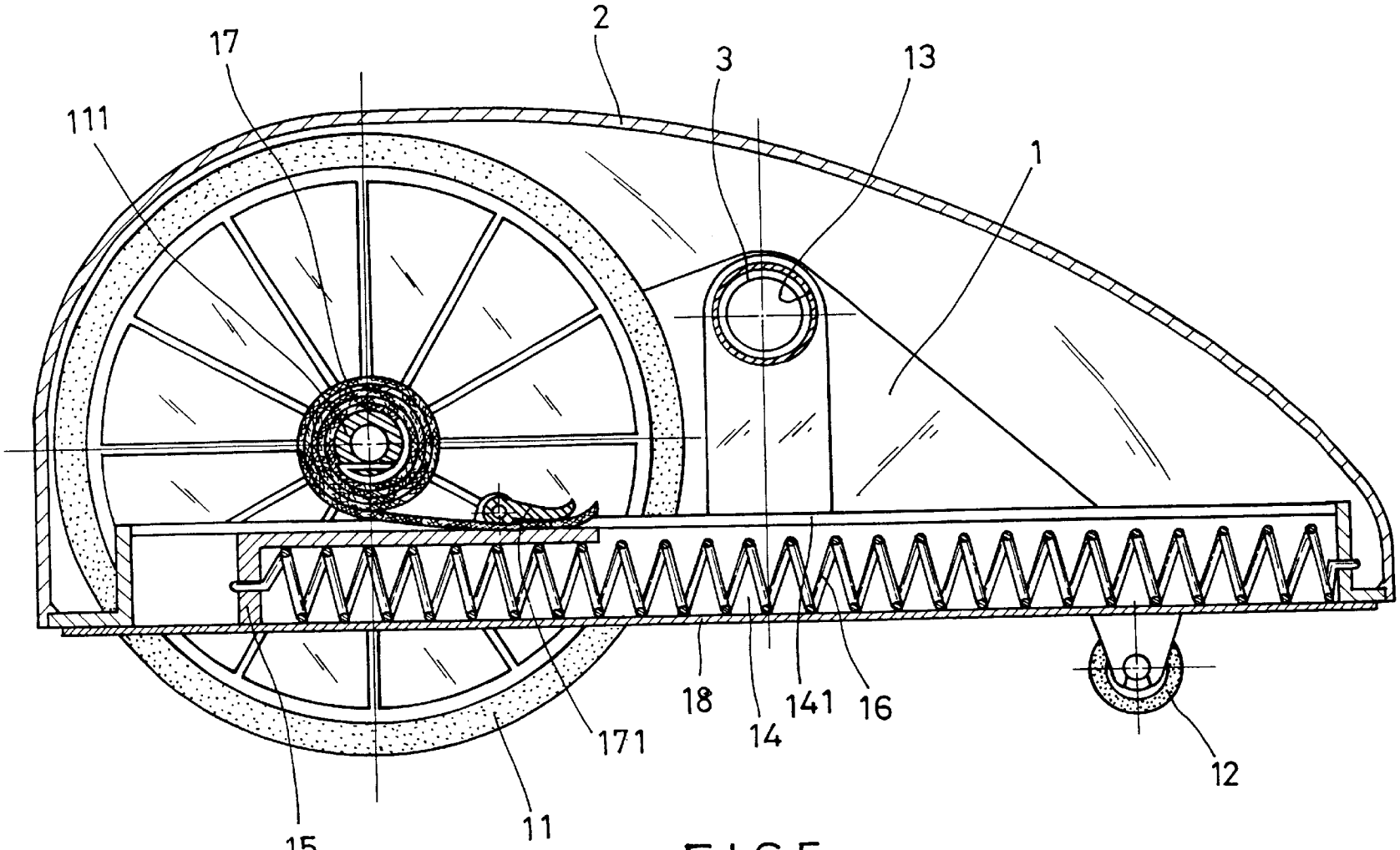
FIG. 5 is similar to FIG. 3 but showing the tensile spring stretched out.

Referring to FIGS. from 1 through 5, an exercise wheel in accordance with the present invention is shown comprised of a wheel base 1, a bottom-open housing 2, a coupling tube 4, and two handgrips 4. The wheel base 1 comprises a wheel axle 111 transversely pivoted thereto near the rear side, two main wheels 11 fixedly mounted on the wheel axle 111 and arranged in parallel, a front balance wheel 12, a longitudinal sliding track 14, two coupling holes 13 bilaterally aligned in front of the main wheels 11 above the longitudinal sliding track 14, a slide 15 longitudinally slidably mounted in the longitudinal sliding track 14, a torsional spring 16 disposed between the slide 15 and the longitudinal sliding track 14 for providing the slide 15 with a recovery force enabling the slide 15 to return to its original position in the longitudinal sliding track 14, and a belt 17 connected between the slide 15 and the wheel axle 111. The housing 2 covers the wheel base 1, comprising two through holes 21 respectively disposed in the two opposite vertical sidewalls thereof. The coupling tube 3 is press-fitted into the through holes 21 of the housing 2 and the coupling holes 13 of the wheel base 1. The handgrips 4 are respectively fastened to the ends of the coupling tube 3 and disposed in the outside of the housing 2. The longitudinal sliding track 14 has two inward top flanges 141 extended in longitudinal direction and arranged in parallel. The slide 15 is inserted into the longitudinal sliding track 14 from the bottom side and longitudinally slidably stopped below the flanges 141. After insertion of the slide 15 into the longitudinal sliding track 14, a locating plate 18 is fastened to the longitudinal sliding track 14 to close the bottom open side of the longitudinal sliding track 14. Further, a buckle 171 is provided at the top side of the slide 15 to hold one end of the belt 17, enabling the user to adjust the tension of the belt 17.

Figure 7:
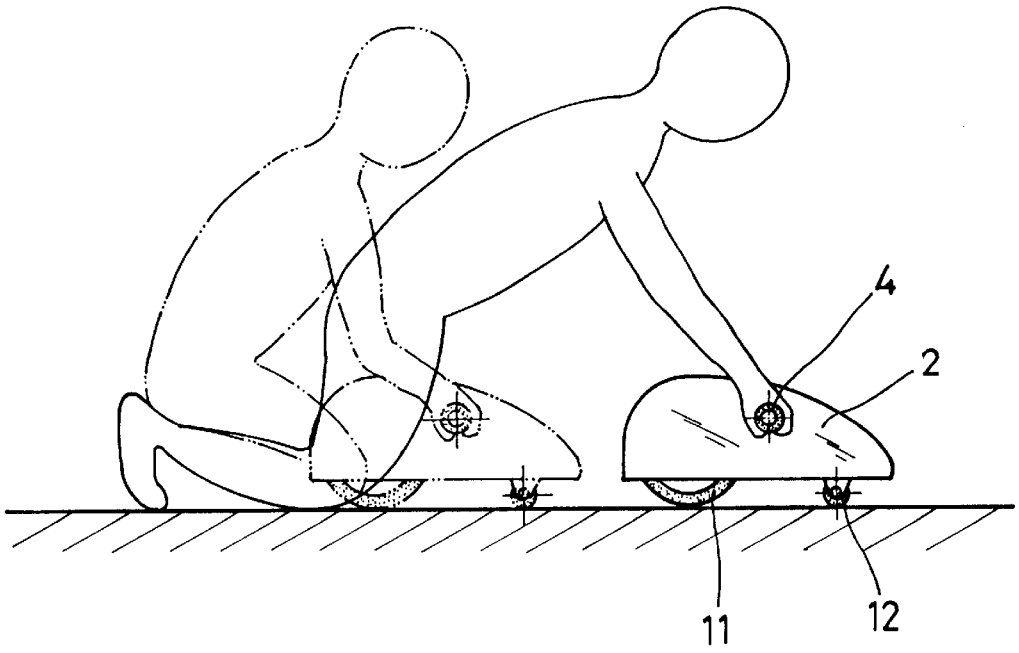
FIG. 7 is a schematic drawing showing one application example of the present invention.

Referring to FIG. 7 and FIGS. from 1 through 5 again, when operating the exercise wheel to move the main wheels 11 back and forth on the floor, the wheel axle 111 is rotated with the main wheels 11 to take up/let off the belt 17. When taking up the belt 17, the slide 15 is pulled toward the main wheels 1 to stretch the tensile spring 16. On the contrary, when letting off the belt 17, the tensile spring 16 immediately returns to its former shape and to pull the slide 15 back to its original position. Because no gear transmission is used, no noise is produced during the operation of the exercise wheel.

Figure 6:
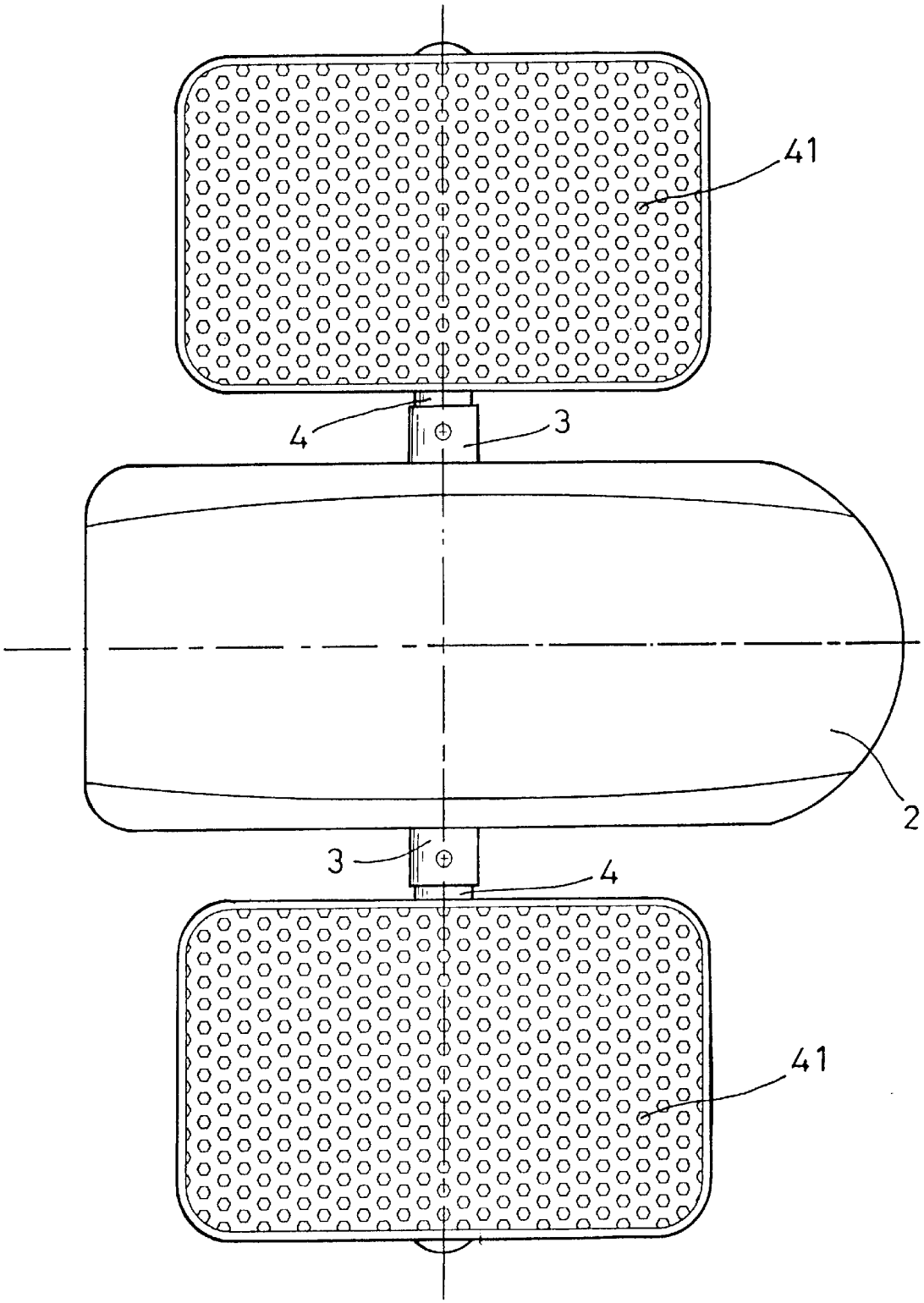
FIG. 6 is a top plain view of an alternate form of the present invention, showing two footplates provided at the handgrips.
Figure 8:
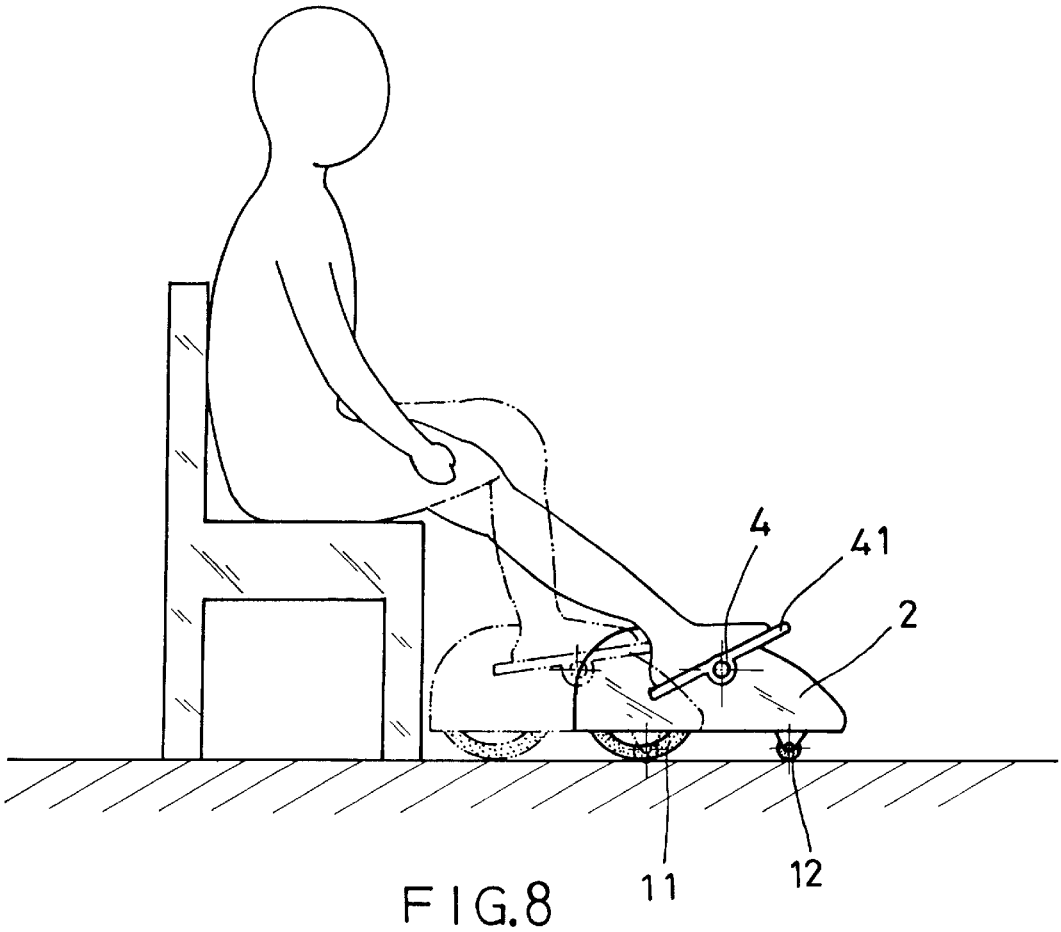
FIG. 8 is a schematic drawing showing another application example of the present invention.
Figure 9:
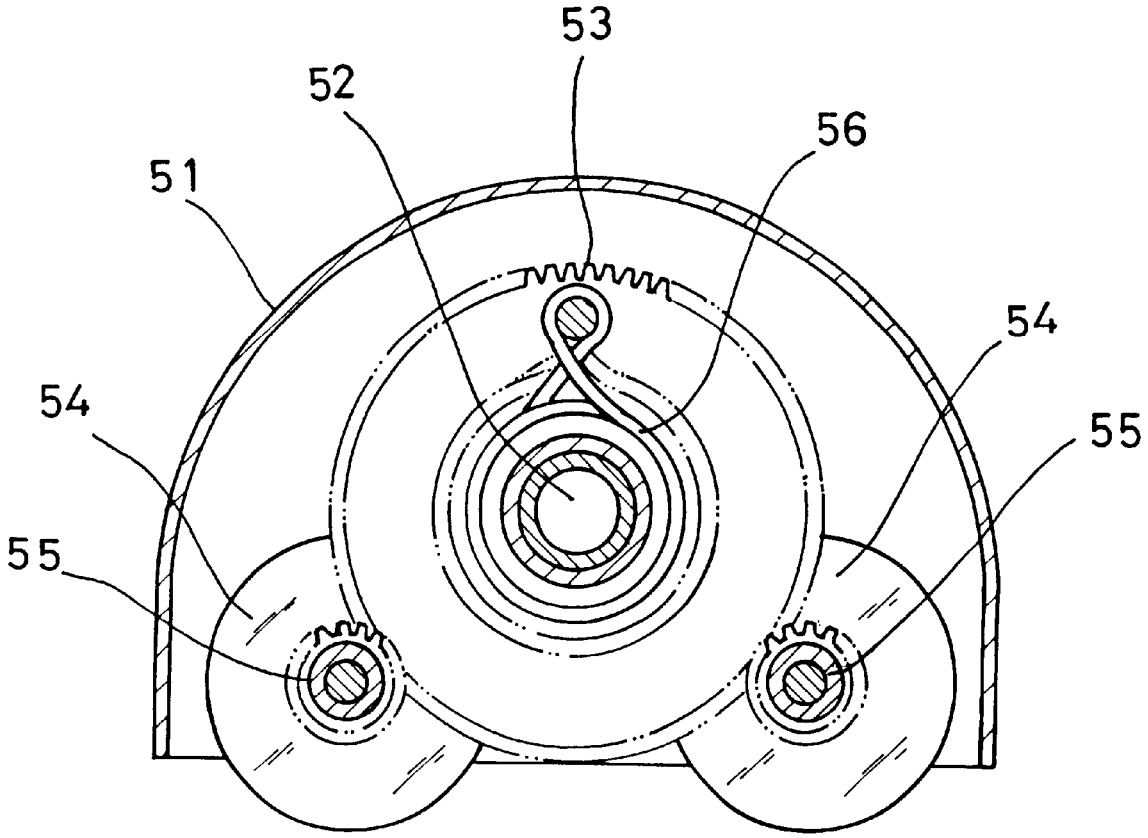
FIG. 9 PRIOR ART
FIG. 9 is a sectional view of an exercise wheel according to the prior art.

Referring to FIGS. 6 and 8, two footplates 41 may be respectively provided at the handgrips 4, so that the user can push and pull the exercise wheel on the floor with the legs to exercise the muscles of the legs.

A prototype of exercise wheel has been constructed with the features of FIGS. 1~8. The exercise wheel functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An exercise wheel comprising:

a wheel base, said wheel base comprising a wheel axle transversely pivoted thereto near a rear side thereof, two main wheels fixedly mounted on said wheel axle and arranged in parallel, a front balance wheel, a longitudinal sliding track, two coupling holes bilaterally aligned in front of said main wheels above said longitudinal sliding track, a slide longitudinally slidably mounted in said longitudinal sliding track, a torsional spring disposed between said slide and said longitudinal sliding track for providing said slide with a recovery force, and a belt, said belt having a first end fixedly connected to said slide and a second end fixedly connected to said wheel axle;

a housing covering said wheel base, said housing comprising two through holes respectively disposed in alignment with the coupling holes of said wheel base at two sides;

a coupling tube press-fitted into the through holes of said housing and the coupling holes of said wheel base; and two handgrips respectively fastened to two distal ends of said coupling tube and disposed in the outside of said housing.

2. The exercise wheel as claimed in claim 1 wherein said longitudinal sliding track has two inward top flanges extended in longitudinal direction and arranged in parallel, a bottom open side, and a locating plate covered on said bottom open side thereof.

3. The exercise wheel as claimed in claim 1 wherein said slide comprises a buckle disposed in the outside of said top flanges of said longitudinal track and adapted to secure the first end of said belt.

4. The exercise wheel as claimed in claim 1 further comprises two footplates respectively provided at said handgrips.

* * * * *